US005586153A

United States Patent [19]

Alvord

[11] Patent Number: 5,586,153

[45] Date of Patent: Dec. 17, 1996

[54] PROCESS FOR PRODUCING RADIONUCLIDES USING POROUS CARBON

[75] Inventor: C. William Alvord, Knox, Tenn.

[73] Assignee: CTI, Inc., Knoxville, Tenn.

[21] Appl. No.: 514,535

[22] Filed: Aug. 14, 1995

[51] Int. Cl.[6] ..... G21C 1/10

[52] U.S. Cl. ..... 376/196; 376/198; 376/199; 376/194; 376/195; 376/201; 376/156; 376/112; 376/108; 376/115

[58] Field of Search ..... 376/196, 198, 376/199, 194, 195, 201, 112, 108, 115, 156; 315/502, 507, 505, 506; 378/143

[56] References Cited

U.S. PATENT DOCUMENTS

| | | | |
|---|---|---|---|
| 2,868,987 | 1/1959 | Salsig, Jr. et al. | 250/43 |
| 3,664,921 | 5/1972 | Christofilos | 376/126 |
| 4,157,471 | 6/1979 | Mlekodaj | 250/423 R |
| 4,444,717 | 4/1984 | de Breze | 376/194 |
| 4,752,432 | 6/1988 | Bida et al. | 376/195 |
| 5,037,602 | 8/1991 | Dabiri et al. | 376/198 |
| 5,135,704 | 8/1992 | Shefer et al. | 376/108 |
| 5,280,505 | 1/1994 | Hughey et al. | 376/156 |
| 5,345,477 | 9/1994 | Wieland et al. | 376/195 |
| 5,392,319 | 2/1995 | Eggers | 376/194 |
| 5,468,355 | 11/1995 | Shefer et al. | 204/157.2 |

OTHER PUBLICATIONS

Morelle, J. L., An Experimental Carbon/Steam Stack Target for In–Situ Production of [13N] Ammonia with Low Energy Deuterons., Fifth.

Fifth International Workshop on Targetry and Target Chemistry, Brookhaven Laboratory, Upton, NY, North Shore University Hospital, Manhasset, NY, Sep. 19 to 23, 1993.

*Primary Examiner*—Charles T. Jordan
*Assistant Examiner*—Meena Chelliah
*Attorney, Agent, or Firm*—Pitts & Brittian, P.C.

[57] ABSTRACT

A process for producing radionuclides using a porous carbon target. The process includes the steps of inserting a porous carbon target with tailored solid and void dimensions in the path of a bombarding beam; introducing fluid into the porous carbon target; bombarding the porous carbon target to produce at least one type of radionuclide; collecting the fluid and separating the resulting radionuclides.

17 Claims, 3 Drawing Sheets

PROCESS FOR PRODUCING RADIONUCLIDES USING POROUS CARBON

TECHNICAL FIELD

This invention relates to the field of producing radionuclides from a target material, and particularly using porous carbon as the target.

BACKGROUND ART

Positron Emission Tomography (PET) is an important imaging modality useful in the early diagnosis and therapy planning of many diseases. It has been demonstrated to be useful and cost effective in the assessment and diagnosis of a variety of heart and brain diseases. Moreover, with the recent development of whole body scanners, the field of oncology is opening up to PET. The availability of PET on a clinical basis helps physicians make therapy choices earlier in the treatment of the patient, thereby improving chances of therapeutic success, as well as reducing the costly work up required to make a clear diagnosis. However, due to the cost of opening and operating a PET center the technique is not widely available. The widespread availability of clinical PET will be strongly influenced by the development of a more economical and compact accelerator for generating PET radionuclides. Typically, the accelerator for producing PET radionuclides is a cyclotron. Generally, the terminal particle energy can be used as a significant determining factor in accelerator cost. An accelerator which utilizes lower bombarding energies (less than 8 MeV protons) and higher beam currents (greater than 100 uA) than that which is presently available, is necessary to minimize accelerator manufacturing costs.

As bombarding energies decrease, so do the number of available target materials that will produce the desired radionuclides in useful quantities. The four conventional PET radionuclides are carbon-11 ($^{11}C$), nitrogen-13 ($^{13}N$), oxygen-15 ($^{15}O$), and fluorine-18 ($^{18}F$).

Most cyclotron targets now in operation take the form of a single phase continuous material, i.e., the material under bombardment is in a completely gaseous, liquid or solid form. Several single phase targets require further processing to release or to make the clinically useful radionuclides. Further, the target materials are limited in the variety of PET radionuclides which can ultimately be produced.

Extensive research has been conducted on the devices for producing PET radionuclides, and more recently, several manufacturers have begun developing machines which supply lower bombarding energies and higher beam currents. Research involving the associated target material to be used with such devices has not been all that extensive. Typical of the art of PET devices and target materials are disclosed in the following U.S. Pats:

| U.S. Pat. No. | Inventor(s) | Issue Date |
|---|---|---|
| 2,579,243 | A. F. Reid | Dec. 18, 1951 |
| 2,868,987 | Salsig et al. | Jan. 13, 1959 |
| 4,752,432 | Bida et al. | June 21, 1988 |
| 5,037,602 | Dabiri et al. | Aug. 6, 1991 |
| 5,135,704 | Shefer et al. | Aug. 4, 1992 |
| 5,280,505 | Hughey et al. | Jan. 18, 1994 |
| 5,345,477 | Wieland et al. | Sept. 6, 1994 |

The U.S. Pat. No. 2,579,243 patent discloses a method for producing of radioactive isotopes which includes the use of a solid sodium metaborate target to provide radioactive sodium.

The U.S. Pat. No. 2,868,987 patent teaches a recirculating liquid target but does not indicate any particular target material.

The U.S. Pat. No. 4,752,432 patent teaches a device and process for producing nitrogen-13 radionuclides from a carbon-13/fluid slurry. The target material is held in position by at least a target window and frits. The frits are fine filters that allow water to pass through but do not allow passage of carbon powder of the target material.

The U.S. Pat. No. 5,037,602 patent teaches a radionuclide production facility for use with PET. The device utilizes a radio frequency quadruple linear accelerator. A particular target material is not taught.

The U.S. Pat. No. 5,135,704 patent teaches a radiation source and an accelerator. Again, a particular target is not taught.

The U.S. Pat. No. 5,280,505 patent teaches a method and apparatus for generating isotopes from a frozen target material. A thin surface layer of the target is frozen and the target is bombarded. The target material is isotopically enriched and when the desired quantity of isotope has been produced, the target is processed to extract the isotopes.

The U.S. Pat. No. 5,345,477 patent teaches a device and process for the production of nitrogen-13 using an ethanol solution target. The target solution is bombarded and the resulting radioactive effluent is subsequently washed from the target chamber by additional target solution. The radioactive effluent is purified and collected for use. The target produces only nitrogen-13 isotopes.

It is an object of the present invention to provide a process for producing radionuclides using a porous carbon target wherein the target, upon being bombarded, produces more than one type of radionuclide.

It is another object of the present invention to provide a process for producing radionuclides using a porous carbon target wherein the target is self supporting.

Further, it is another object of the present invention to provide such a process wherein the dimensions of the pores and the fibers of the porous carbon target can be specifically tailored.

DISCLOSURE OF THE INVENTION

Other objects and advantages will be accomplished by the present invention which serves to provide a process for producing radionuclides using a porous carbon target. The process of the present invention generally includes the steps of inserting the porous carbon monolithic target with tailored solid and void dimensions in the path of a beam of an accelerator; introducing a fluid through the porous carbon target; bombarding the porous carbon target to form at least one type of radionuclide; collecting the fluid circulating through the porous carbon target; and, if necessary, separating the resulting radionuclides.

BRIEF DESCRIPTION OF THE DRAWINGS

The above mentioned features of the invention will become more clearly understood from the following detailed description of the invention read together with the drawings in which.

BEST MODE FOR CARRYING OUT THE INVENTION

A process for producing radionuclides using a porous carbon target is illustrated generally at 10 in the figures. The process 10 is designed to provide at least one of the four radionuclides used in positron emission tomography from a single target, the four radionuclides being carbon-11 ($^{11}C$), nitrogen-13 ($^{13}N$), oxygen-15 ($^{15}O$), and fluorine-18 ($^{18}F$). In one embodiment, all four radionuclides are produced from a single target. Further, the process 10 includes the use of a target which is self supporting and the dimensions of which are tailorable. Although the isotopes are primarily emphasized for use with PET, it is not intended to limit their use therein.

Figure 1:
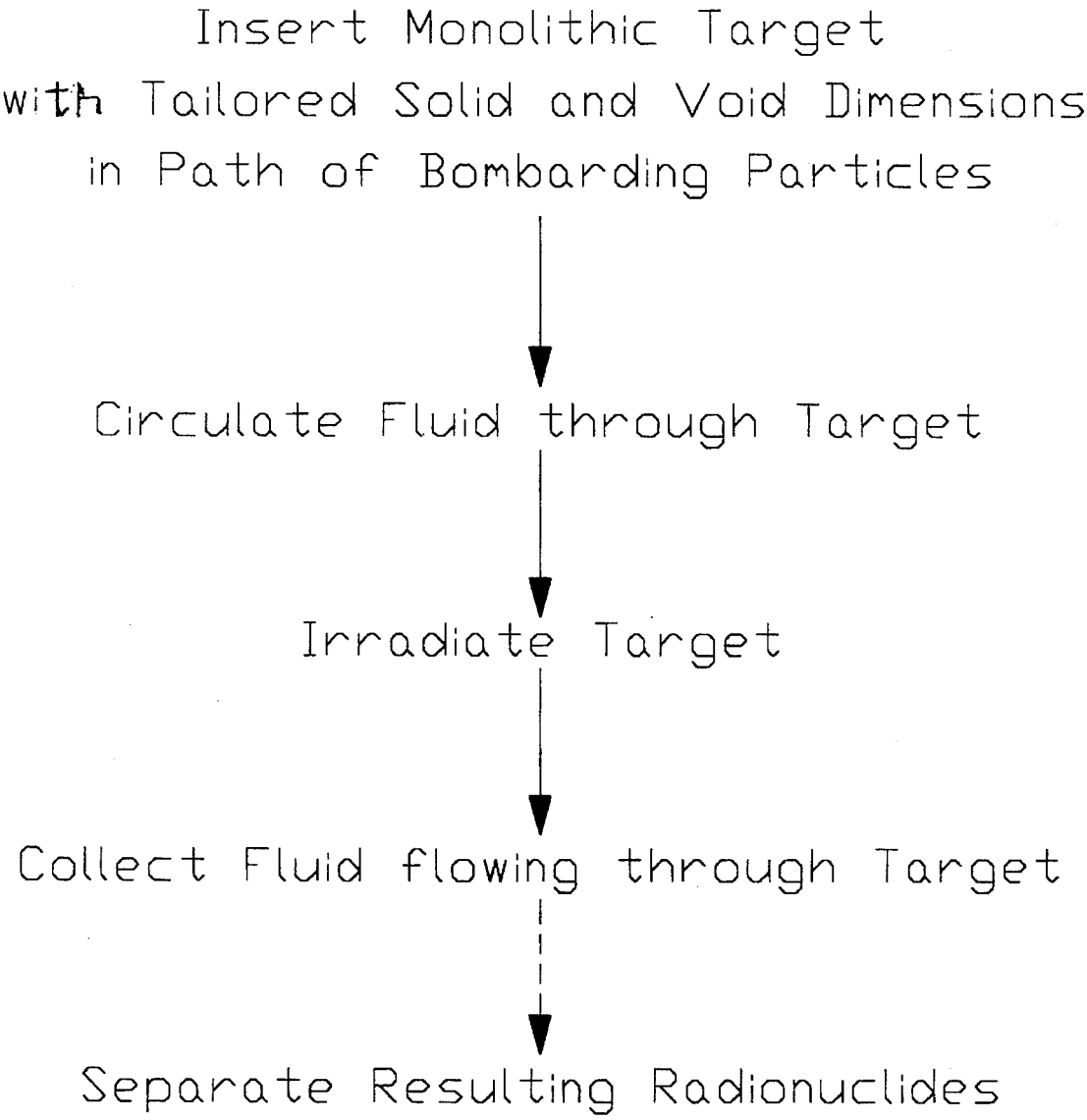
FIG. 1 is a schematic diagram of a process depicting various features of the present invention showing the general steps for utilization of a porous carbon target to produce radionuclides.

The process 10 is depicted generally in the block diagram of FIG. 1. The process 10 generally includes inserting a porous carbon monolithic target with tailored solid and void dimensions in the path of a beam of bombarding particles, introducing a fluid through the porous carbon target, bombarding the target, and recovering the resulting radionuclides by collecting the fluid and, if necessary, sorting the different types of radionuclides. In an embodiment where only one radionuclide is produced a sorting or separation step is not necessary.

Figure 2:
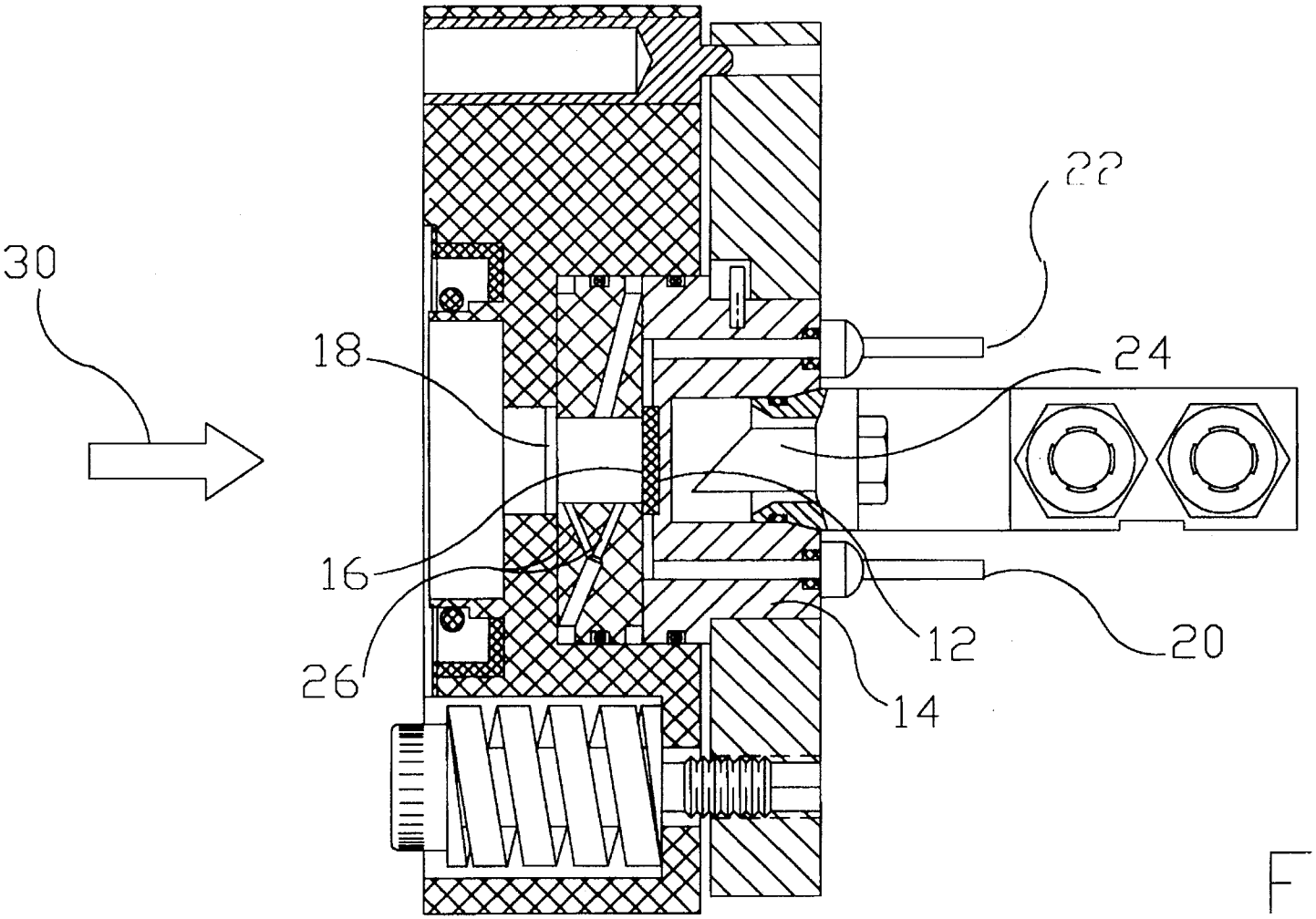
FIG. 2 illustrates an example of a typical arrangement for bombarding a target material.

FIG. 2 illustrates a conventional arrangement for bombarding a porous carbon target 12. The arrangement generally includes a target body 14 for retaining the target 12, a target window 16 positioned in front of the target 12, and a vacuum window 18 positioned in front of the target window 16. Target fluid enters through the target body 14 at an inlet 20, flows through the target 12 and exits through an outlet 22. Cooling water 24 is circulated through the target body 14 and helium cooling jets 26 are utilized to cool the region between the vacuum window 18 and the target window 16. An accelerated particle beam 30 is directed at the target 12 and bombards the target 12. The isotopes produced are retrieved from the fluid running through the target and exiting the target 12, via the outlet 22.

Figure 3:
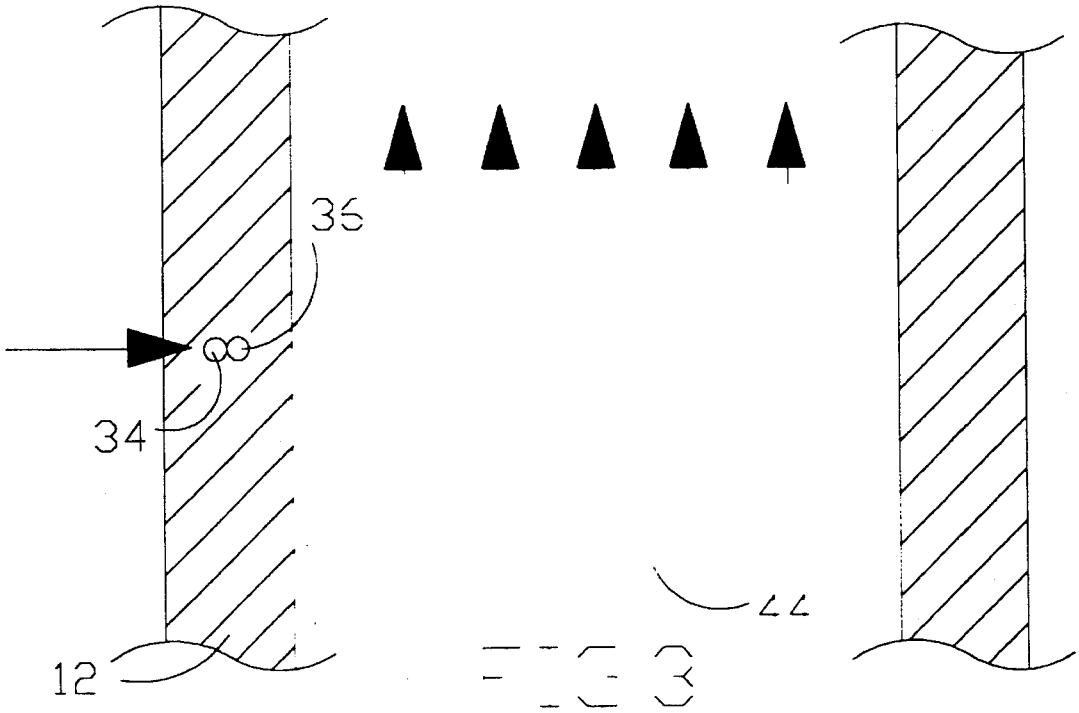
FIGS. 3 illustrates the initial bombardment of a target nucleus.
Figure 4:
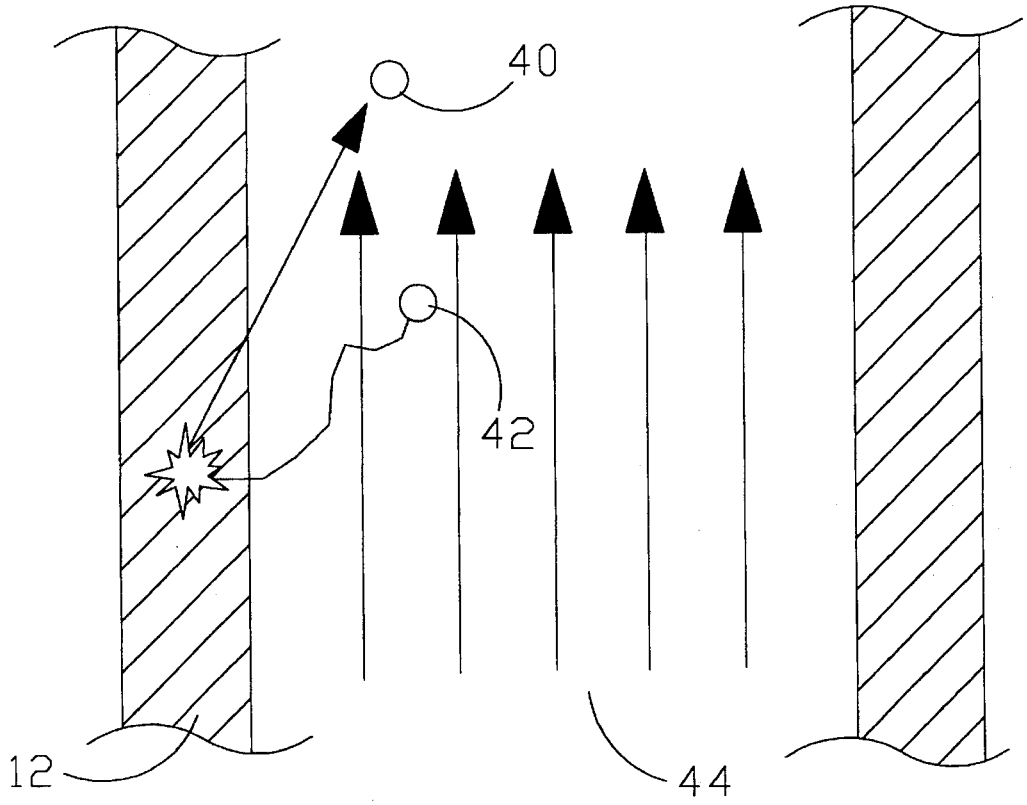
FIG. 4 illustrates the recoil escape of the product nucleus.

FIGS. 3 and 4 illustrate the bombardment of the target and subsequent recoil of the product. In FIG. 3 an incident bombarding particle 34 interacts with a target nucleus 36 in the target 12. In FIG. 4, the products of the reaction are the emitted particle 40 and the product nucleus 42. Optimized recoil is the case of the maximum number of product nuclei 42 that stop and are recovered in the fluid 44.

In the preferred embodiment, the accelerator provides a $^{3}He$ beam with energies ranging from 5 MeV to 20 MeV, and preferably, the target is bombarded with a 10 MeV $^{3}He$ beam. The accelerator can be of any type, although cyclotrons are most common. Other useful bombarding particles are deuterons at up to 10 MeV to make $^{13}N$ by the $^{12}C(d,n)^{13}C$ reaction, or protons up to 15 MeV on enriched $^{13}C$ porous carbon to make $^{13}N$ by the $^{12}C(p,n)^{13}N$ reaction.

To produce all four radionuclides from a single target, fluid which is oxygen-16 rich is flowed through the target. The target is the combination of the porous carbon and the oxygen-16 within the fluid. In the preferred embodiment, water or steam is the fluid utilized to flow through the porous carbon. Oxygen-16 ($^{16}O$) is a naturally occurring isotope in water. The irradiation of the porous carbon and the oxygen-16 with a $^{3}He$ beam produces the four isotopes mentioned above. Specifically, the nuclear reactions are $^{12}C(^{3}He,^{4}He)^{11}C$, $^{12}C(^{3}He,d)^{13}N$, $^{12}C(^{3}He,pn)^{13}N$, $^{16}O(^{3}He,p)^{18}F$, and $^{16}O(^{3}He,^{4}He)^{15}O$.

The porous carbon target is self supporting, structurally stable and the dimensions of the carbon fiber and the pore volume of the target are tailorable. Because it is self supporting, the porous carbon does not require the use of screens or frits to contain it during the bombarding process. This is advantageous because screens and frits clog very easily. Further, the stability of the porous carbon target reduces or eliminates the need for servicing the target to continue radiation of the target. Moreover, the porous carbon target has an extended lifetime in comparison to targets of the prior art.

Control of the dimensions of the carbon fibers and the pore volume of the target are essential to maximizing or optimizing the production of the desired isotopes. The recoil kinetics of the radionuclides dictate the dimensions of the porous carbon, including the carbon fiber dimensions and the pore volume. More specifically, during bombardment the fraction of radionuclides coming out of the carbon and remaining in the water within the pores is dependent upon the dimensions of the carbon fibers and the pores. Further, the amount of radionuclides, resulting from the bombardment of $^{16}O$ in the water, remaining in the water is dependent upon the dimensions of the pores. To optimize the escape mechanisms of the radionuclides the structure of the target must be customized. Recent advances such as photoetching, plasma etching, sputter coating, electron beam evaporation coating, chemical vapor deposition, sol gel and aerosol techniques, supercritical fluid extraction, and microcellular polymer foams provide techniques for controlling carbon fiber sizes down to micron and submicron sizes. Typical solid or fiber dimensions range from 0.05 microns to 5 microns and the pores range from 0.5 microns to 50 microns, but may be larger or smaller. It will be noted that the dimensions indicated above are provided as an example of the dimensions, it is not an intention to limit the dimensions to the above indicated ranges.

In an alternate embodiment, steam is circulated through the pores of the porous carbon target. Because of the high melting point of carbon the high temperature steam does not threaten the structural integrity of the porous carbon target. In this embodiment, the porous carbon target defines a much larger void fraction than the porous carbon/water target.

It will be noted that in addition to serving as a target for the production of radionuclides, the water or steam serves as a carrier for the radionuclides as indicated above and also, the water or steam serves as a coolant for the target. Further, it will be noted that although the use of water or steam as the circulating fluid is discussed, it is not intended to restrict the present method, and any suitable fluid can be used.

From the foregoing description, it will be recognized by those skilled in the art that a process for producing radionuclides from a porous carbon target offering advantages over the prior art has been provided. Specifically, the process provides a means for producing more than one type of radionuclide from a single target. Further, the target is self supporting such that the target does not require the use of frits to contain the target material and the concomitant level of service is reduced. Further, the dimensions of the porous carbon are tailorable such that maximization or optimization of the production of radionuclides is possible.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A process for producing radionuclides using a porous carbon monolithic target with tailored solid and void dimensions, said process comprising the steps of:

inserting said porous carbon target in a path of a beam of bombarding particles in an accelerator;

introducing a fluid into said porous carbon target;

irradiating said porous carbon target with said beam of bombarding particles thereby forming at least one type of radionuclide; and, collecting said fluid introduced into said porous carbon target.

2. The process of claim 1 wherein said bombarding particles are helium-3 ($^3$He).

3. The process of claim 2 further including the step of separating said at least one type of radionuclide after collecting said fluid, said at least one type of radionuclide belonging to a group comprising carbon-11 and nitrogen-13.

4. The process of claim 2 wherein said fluid contains oxygen-16.

5. The process of claim 4 further including the step of separating said at least one type of radionuclide after collecting said fluid, said at least one type of radionuclide belonging to a group comprising carbon-11, nitrogen-13, oxygen-15, and fluorine-18.

6. The process of claim 2 wherein the energy of said bombarding particles of $^3$He is less than 20 MeV.

7. The process of claim 1 wherein said fluid is water.

8. The process of claim 1 wherein said fluid is steam.

9. The process of claim 1 wherein said bombarding particles are deuterons.

10. The process of claim 9 wherein said least one radionuclide is nitrogen-13.

11. The process of claim 1 wherein said bombarding particles are protons.

12. The process of claim 11 wherein said least one radionuclide is nitrogen-13.

13. A process for producing radionuclides using a porous carbon monolithic target with tailored solid and void dimensions, said process comprising the steps of:

inserting said porous carbon target in a path of a beam of helium-3 ($^3$He) in an accelerator;

introducing a fluid containing oxygen-16 into said porous carbon target;

irradiating said porous carbon target with said beam of helium-3 thereby forming at least one type of radionuclide;

collecting said fluid introduced into said porous carbon target; and, separating said at least one type of radionuclide.

14. The process of claim 13 wherein said at least one type of radionuclide belongs to a group comprising carbon-11, nitrogen-13, oxygen-15, and fluorine-18.

15. The process of claim 13 wherein the energy of said beam of $^3$He is less than 20 MeV.

16. The process of claim 13 wherein said fluid is water.

17. The process of claim 13 wherein said fluid is steam.

* * * * *